US006655477B2

(12) United States Patent
Appleton et al.

(10) Patent No.: US 6,655,477 B2
(45) Date of Patent: Dec. 2, 2003

(54) FRICTION-REDUCING DRILL PIPE COMPONENT

(75) Inventors: Robert Patrick Appleton, Banchory (GB); Gholam Hossein Rastegar, Peterculter (GB)

(73) Assignee: Drilltech Services (ASIA) Pte Limited (SG)

( * ) Notice: Subject to any disclaimer, the term of this patent is extended or adjusted under 35 U.S.C. 154(b) by 37 days.

(21) Appl. No.: 09/029,509

(22) PCT Filed: Aug. 30, 1996

(86) PCT No.: PCT/GB96/02123

§ 371 (c)(1),
(2), (4) Date: Feb. 27, 1998

(87) PCT Pub. No.: WO97/08423

PCT Pub. Date: Mar. 6, 1997

(65) Prior Publication Data

US 2002/0023782 A1 Feb. 28, 2002

(30) Foreign Application Priority Data

Aug. 30, 1995 (GB) ..... 9517649
Oct. 7, 1995 (GB) ..... 9520549

(51) Int. Cl.[7] ..... E21B 17/10
(52) U.S. Cl. ..... 175/325.3; 166/241.6
(58) Field of Search ..... 175/325.1, 325.3, 175/325.5, 325.2; 166/241.6

(56) References Cited

U.S. PATENT DOCUMENTS

| | | | | | |
|---|---|---|---|---|---|
| 2,715,552 | A | * | 8/1955 | Lane | 175/325.5 |
| 2,846,016 | A | * | 8/1958 | Hanes | 403/19 |
| 3,482,889 | A | * | 12/1969 | Cochran | 175/325.5 |
| 3,825,083 | A | | 7/1974 | Flarity et al. | 175/394 |
| 3,916,998 | A | * | 11/1975 | Bass, Jr. et al. | 175/325.5 |
| 4,606,417 | A | * | 8/1986 | Webb et al. | 175/76 |
| 5,020,591 | A | * | 6/1991 | Shore | 166/55 |

FOREIGN PATENT DOCUMENTS

| | | | |
|---|---|---|---|
| EP | 508329 | * | 10/1992 |
| GB | 1180017 | * | 2/1970 |
| WO | WO 95/05521 | * | 2/1995 |
| WO | WO 95/10685 | * | 4/1995 |

* cited by examiner

*Primary Examiner*—Robert E. Pezzuto
*Assistant Examiner*—Meredith Petravick
(74) *Attorney, Agent, or Firm*—Gifford, Krass, Groh, Sprinkle, Anderson & Citkowski, P.C.

(57) ABSTRACT

The friction reducing drill pipe component in the form of a sub (10) is adapted to form part of a drill string. The sub (10) comprises a tubular mandrel (12) having first and second ends for connection to adjacent components of the drill string. A sleeve (18) is mounted on the mandrel (12), and first and second stops on the mandrel (16, 20) restrain the sleeve 18 against axial movement relative to the mandrel (12). One of the stops (20) is removable or retractable to permit the sleeve (18) to be removed over the first end of the mandrel.

33 Claims, 5 Drawing Sheets

FRICTION-REDUCING DRILL PIPE COMPONENT

This invention relates to a drill pipe component, and in particular to a component to be placed in a string of drill pipe to reduce the friction between the string and the hole wall.

In industries where long holes or bores are drilled, such as the oil and gas exploration and extraction industries, the friction which occurs due to contact between the drill string and the bore wall may result in a substantial increase in the torque required to rotate the string and the drill bit. Such contact also causes wear and damage to the steel casing used to line sections of the bore.

In an effort to avoid these difficulties there have been various proposals for friction reducing components to be mounted in or on the string. U.S. Pat. No. 5,261,498 (The Red Baron (Oil Tools Rental) Limited) describes a typical friction reducing component or sub, in which a bore wall contacting sleeve is mounted on the lower part of a mandrel via bearings and is axially retained on the lower mandrel part between a shoulder and an upper mandrel part. While this and other subs have been used successfully in numerous operations, the cost and complexity of such subs has limited their widespread adoption and use.

It is among the objects of embodiments of the present invention to provide a friction-reducing drill pipe component which is relatively simple in construction and is thus less expensive to manufacture and maintain.

According to the present invention there is provided a friction-reducing drill pipe component for forming part of a drill string, the component comprising a tubular mandrel having first and second ends for connection to adjacent components of the drill string, a sleeve mounted on the mandrel, and first and second stops on the mandrel for restraining the sleeve against axial movement relative to the mandrel, at least the first stop being removable from the mandrel to permit the sleeve to be removed over the first end of the mandrel.

In use, the major parts of the component may be disassembled simply by removing the first stop and then lifting the sleeve over the first end of the mandrel. This contrasts with conventional arrangements in which removal of the sleeve, if possible, requires, for example, the dismantling of the mandrel or heat treatment and expansion of the sleeve. Thus, maintenance and repair of components made in accordance with embodiments of the present invention is relatively simple and in many instances may be carried out on-site at a drilling location.

The sleeve may be rotatable relative to the mandrel or may be non-rotatable on the mandrel. In this area, components or subs in which the sleeve is fixed relative to a mandrel are described as "rotating" subs, as the sleeve rotates in the bore with the drill string. If the sleeve is rotatable on the mandrel such subs are described as "non-rotating" subs, as the sleeve remains stationary relative to the bore.

In non-rotating subs, bearings may be provided between the sleeve and mandrel, or the sleeve and mandrel may define bearing surfaces. Where bearings are provided these may be introduced into the gap between the sleeve and the mandrel through a port in the sleeve. Bearing lubricant may be trapped between the mandrel and sleeve, however it is preferred that the fluid in the bore provides the necessary lubrication, and to this end the spacing of the stops may be selected to provide a flow path between the stops and the sleeve ends. One of the upper stop and the upper end of the sleeve may be configured to permit flow of fluid therebetween in the event that the contact between the sleeve and bore wall causes the sleeve to be pushed upwardly into contact with the upper stop, for example the upper end of the sleeve or the stop may be scalloped. Alternatively, ports may be provided in the upper end of the sleeve.

Preferably, the first stop is in the form of a collar. The collar may engage with a screw thread formed on the mandrel or may be retained on the mandrel by releasable connectors. The releasable connectors may be in the form of bolts or pins or, most preferably, are in the form of sprung pins or dogs which normally extend radially from the mandrel to engage and retain the collar. The collar may define ports therethrough to allow the dogs to be pushed inwardly to allow removal of the collar. The collar may also define slots in communication with the ports so that the collar may be rotated to cover the pins. Where sprung dogs are utilised to retain the sleeve, the dogs may be pushed inwardly to permit removal of the sleeve. Thus, with this embodiment of the invention it is possible for unskilled personnel to remove and replace the sleeve using only very simple tools, such that components may be repaired on-site without requiring specialised assistance or equipment.

Preferably also, the second stop is in the form of a stop ring. The ring may be removable but is preferably integral with the mandrel. In the preferred embodiment the mandrel, the mandrel end connections and the second stop are machined from a single piece of metal. The first stop and the sleeve may each also be formed of single pieces of metal. Accordingly, the resulting connector has only a small number of parts and is therefore easily assembled and disassembled and may be of robust construction.

The sleeve may have a cylindrical outer surface, or may define axial or helical blades with slots therebetween, to facilitate passage of drilling fluid through the annulus between the drill string and the bore wall. The blades may be of resilient material, such as PTFE, PEEK polymeric material, or vulcanised neoprene, most preferably reinforced with metal or some other rigid structure. Alternatively, the blades may be of metal, such as steel or alloy. The metal blades may be integral with the sleeve or welded or otherwise bonded to the sleeve. The slots may be undercut.

According to another aspect of the present invention there is provided a friction-reducing drill pipe component for forming part of a drill string, the component comprising a tubular mandrel having first and second ends for connection to adjacent components of the drill string, and a sleeve mounted on the mandrel, the sleeve defining external blades with undercut channels therebetween.

According to a further aspect of the present invention there is provided a friction-reducing drill pipe component for forming part of a drill string, the component comprising a tubular mandrel having first and second ends for connection to adjacent components of the drill string, a sleeve mounted on the mandrel, and spring-mounted lock dogs mounted on the mandrel and operatively associated with the sleeve for releasably retaining the sleeve on the mandrel.

These and other aspects of the present invention will now be described, by way of example, with reference to the accompanying drawings, in which.

Figure 1:
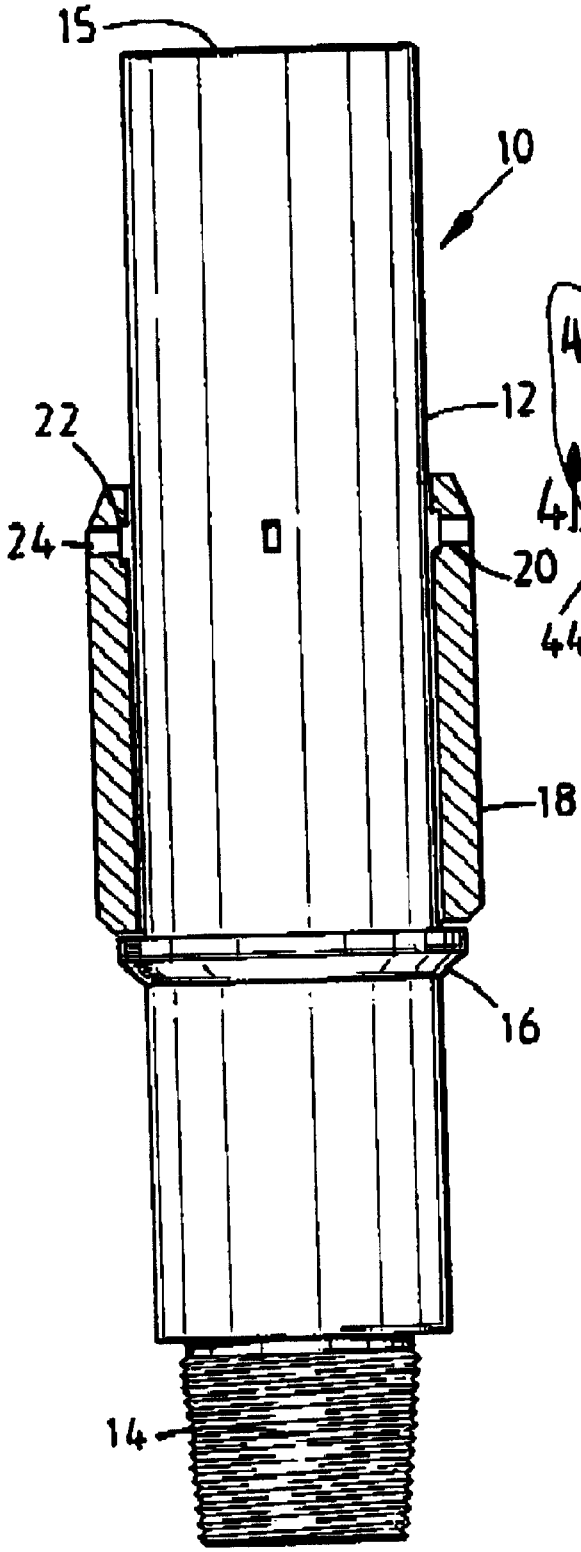
FIG. 1 is a part-sectional view of a friction-reducing drill pipe component in accordance with a first embodiment of the present invention.

Reference is first made to FIG. 1 of the drawings, which illustrates a friction-reducing drill pipe component in the form of a sub 10 forming part of a drill string (not shown) for location in a drilled bore. The sub 10 comprises a tubular body or mandrel 12 provided with conventional conical threaded pin and box connections 14, 15 to permit the sub 10 to form part of a drill string. A stop ring 16 is formed on the mandrel 12 and locates the lower end of a sleeve 18. The upper end of the sleeve 18 is located by a stop comprising a set of sprung lock dogs 20 biassed to extend radially from the mandrel 12 into corresponding slots 22 defined on the inner surface of the sleeve 18. In this embodiment the sleeve is a "rotating" sleeve, in that it rotates with the mandrel 12.

To remove the sleeve 18 from the mandrel 12 an operator depresses the lock dogs 20 by pushing on the lock dogs 20 through the sleeve ports 24 which communicate with the slots 22. When the lock dogs 20 are pushed inwardly the sleeve 18 may be lifted over the depressed dogs 20, and removed from the end of the mandrel.

Figure 2:
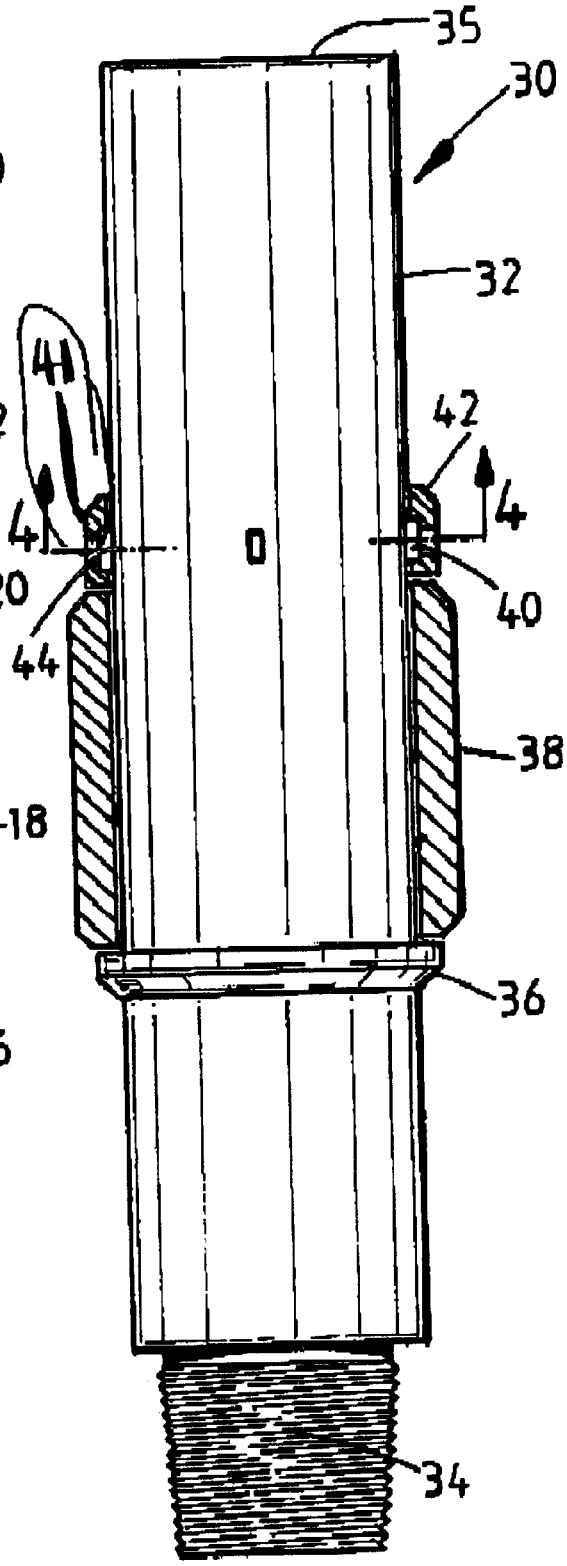
FIG. 2 is a part-sectional view of a friction-reducing drill pipe component in accordance with a second embodiment of the present invention.
Figure 3:
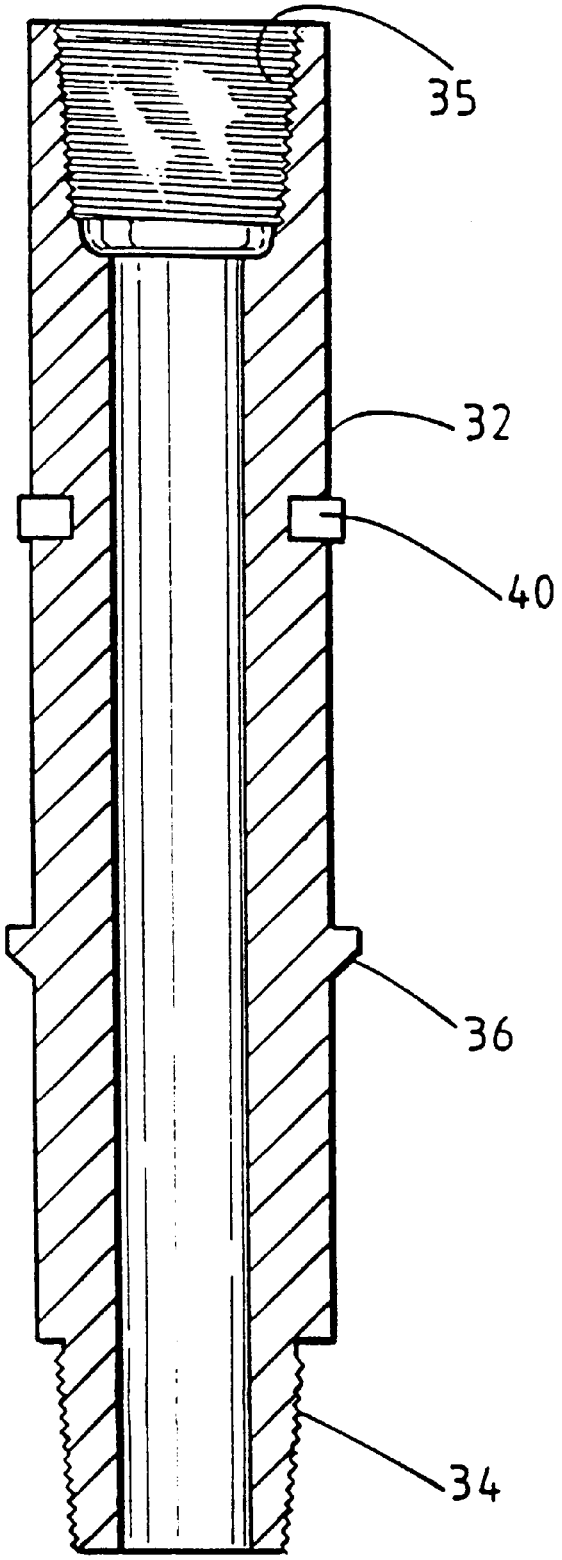
FIG. 3 is a sectional view of the mandrel of the component of FIG. 2.
Figure 4:
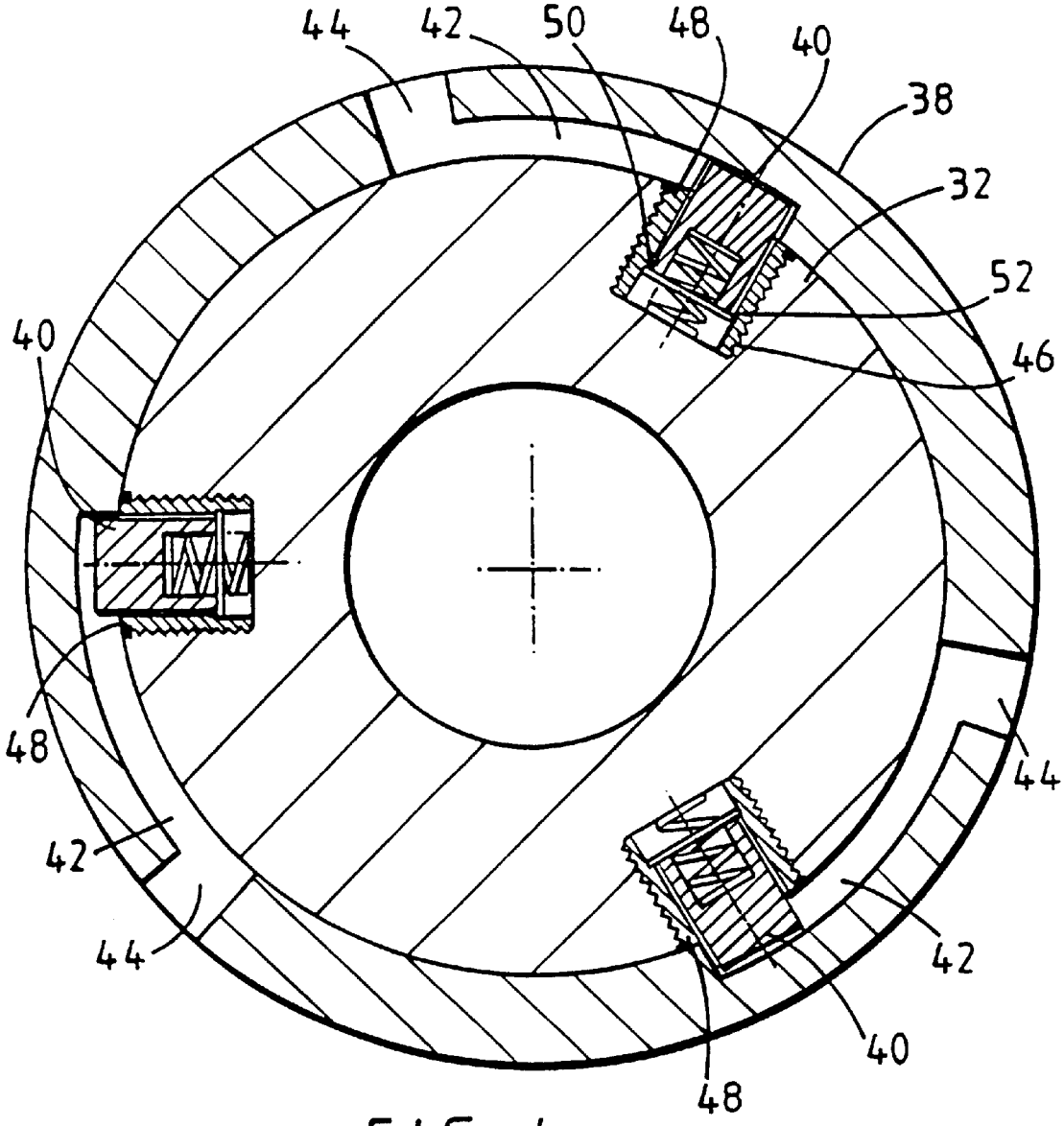
FIG. 4 is a sectional view on line 4—4 of FIG. 2.

Reference is now made to FIGS. 2, 3 and 4 of the drawings, which illustrate a friction-reducing pipe component in the form of a sub 30 in accordance with a further embodiment of the present invention. The sub 30 is somewhat similar to the sub 10 described above, in that it comprises a tubular mandrel 32 defining corresponding pin and box connections 34, 35 and carrying a stop ring 36 to retain a sleeve 38 on the mandrel 32. Further, the upper end of the sleeve 38 is retained by lock dogs 40. However, the lock dogs 40 engage with a lock collar 41 rather than with the sleeve 38, which is thus free to rotate on the mandrel 32. Those working in the area would describe the sleeve 38 as of the "non-rotating" type, as in use the sleeve 38 remains stationary relative to the bore wall, while the mandrel 32 and the remainder of the drill string rotates.

The lock dogs 40 engage slots 42 in the collar 41, and ports 44 provide operator access to the lock dogs 40. Each port 44 is located at one end of the respective slot 42, such that the collar 41 may be rotated on the mandrel 32 until the dogs 40 engage the other "closed" end of the slot 42. Of course the ports 44 and slots 42 are arranged such that rotation of the sub 30 in a bore tends to result in rotation of the collar 41 to bring the dogs 40 to the closed ends of the slots 42.

The lock dogs 40 are illustrated in greater detail in FIG. 4 of the drawings. Each lock dog 40 is located in a respective threaded hole 46 which accommodates a stepped and threaded lock dog retainer 48. A larger diameter stop 50 is provided on each lock dog 40 to engage a retainer shoulder 52 and limit the outward radial extension of the dog 40. A compression spring is provided between each lock dog and the base of the hole 46, to urge the dog radially outwardly. The dogs 40 are ported to prevent the dogs being pushed inwardly by the elevated pressures experienced downhole.

In use, a number of subs 30 will be provided in a drill string, and as the string is rotated in a bore the sleeve 38, which is of larger diameter than the other parts of the drill string, will contact the casing which lines the bore and the mandrel 32 will rotate relative to the non-rotating sleeve 38. In this particular embodiment the mandrel 32 and the sleeve 38 each define plane bearing surfaces, however lubrication is provided by the drilling mud which, during a drilling operation, will flow upwardly through the annulus between the sub 30 and the bore casing. This drilling mud will find its way between the stop ring 36 and the lower end of the sleeve 38, pass between the mandrel and the sleeve, and then flow out between the upper end of the sleeve 38 and the collar 41. To ensure that the fluid may flow out between the upper end of the sleeve 38 and the collar 41, the collar 41 is scalloped.

From FIG. 3 of the drawings it will be noted that the mandrel 32 and stop ring 36 are formed from a single piece of metal. Further, the sleeve 38 and collar 41 are also each formed of a single piece of metal. The sub 30 is therefore very robust, and tests have revealed that the various parts of the sub 30 experience very little wear under normal circumstances. However, if it is desired to remove the sleeve 38 from the mandrel 32, this is achieved by depressing the lock dogs 40 to allow removal of the collar 41, and then depressing the lock dogs to allow removal of the sleeve 38 from the end of the mandrel. Similarly, the sleeve 38 may be refitted on the mandrel 32 with equal ease.

Figure 5:
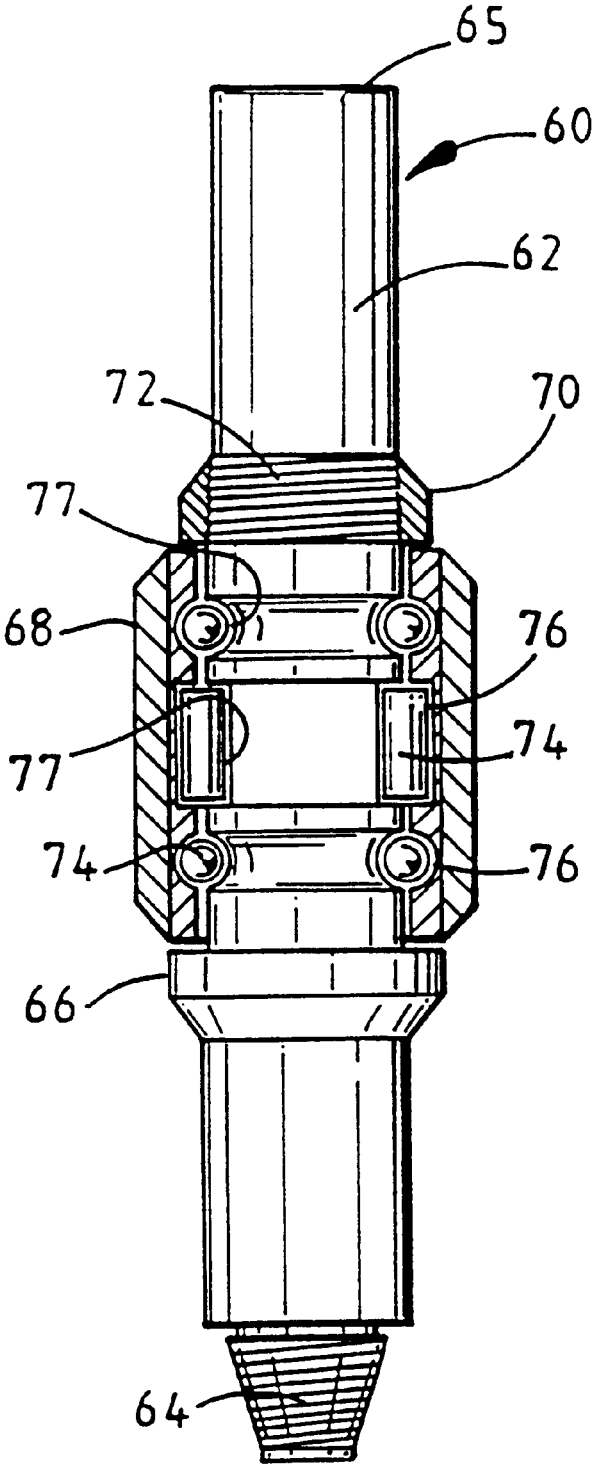
FIG. 5 is a part-sectional view of a friction-reducing drill pipe component in accordance with another embodiment of the present invention.
Figure 6:
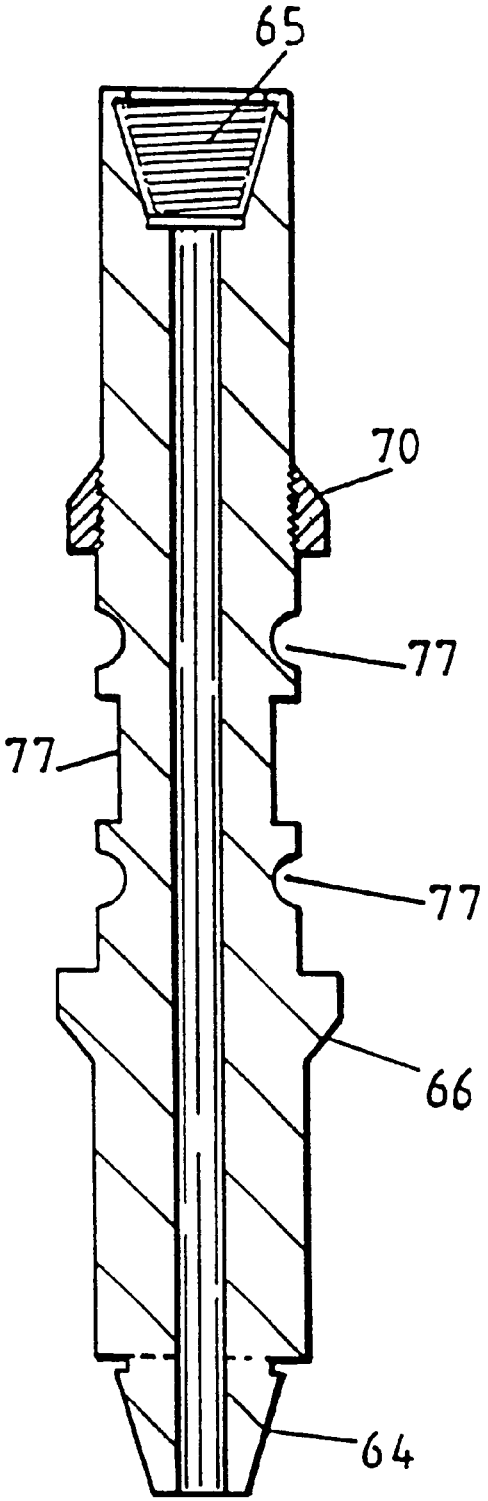
FIG. 6 is a sectional view of the mandrel of the component of FIG. 5.
Figure 7:
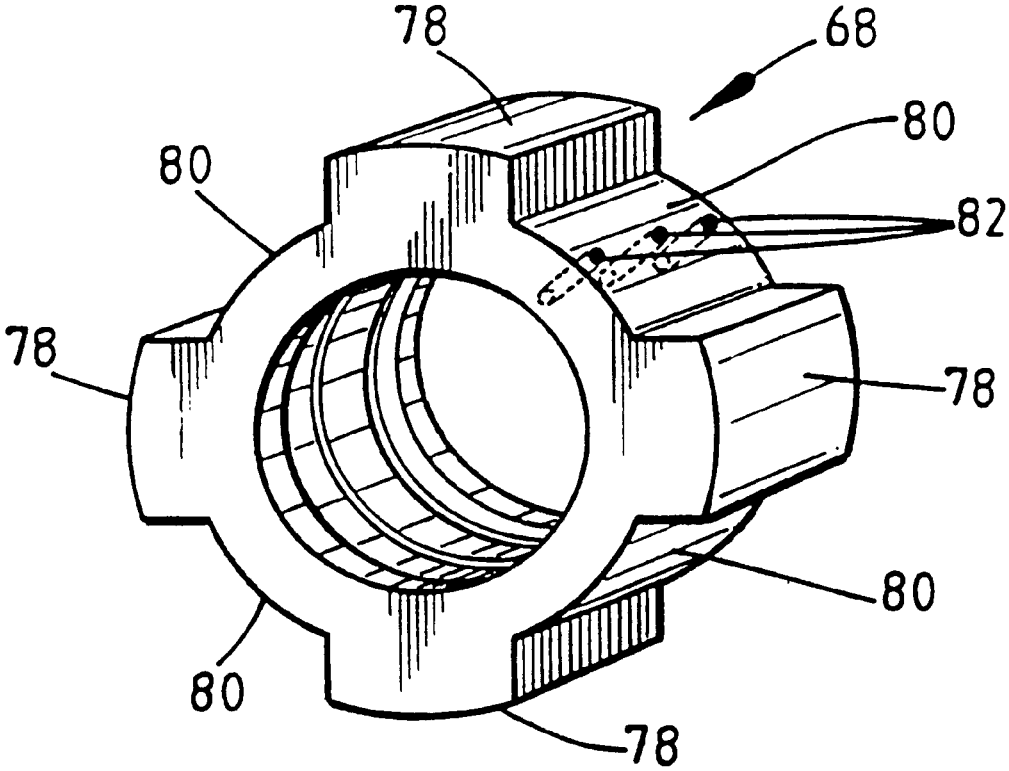
FIG. 7 is a perspective view of the sleeve of the component of FIG. 5.

Reference is now made to FIGS. 5, 6 and 7 of the drawings which illustrate a friction-reducing drill pipe component in the form of a sub 60 in accordance with a further embodiment of the present invention. The sub comprises a tubular mandrel 62 provided with conventional pin and box connections 64, 65 to permit the sub 60 to form part of a drill string. The mandrel also defines a stop ring 66 which locates the lower end of a sleeve 68, the upper end of the sleeve 68 being located by a collar 70 which engages a thread 72 cut on the outer surface of the mandrel 62. Like the sub 30 described above, the sleeve 68 is rotatable on the mandrel 62, and in this embodiment various bearings 74 are provided between the sleeve 68 and the mandrel 62, the opposing faces of which are shaped to define appropriate bearing races or tracks 76, 77 (it should be noted that the dimensions of the bearings 74 and the tracks, 76, 77 are shown somewhat exaggerated in the Figures).

Reference is now made in particular to FIG. 7 of the drawings, which illustrates the sleeve 68. It will be noted that the sleeve 68 defines four axially extending blades 78 with channels or slots 80 therebetween. The blades 78 are formed of steel, a metal alloy or a resilient material, such as PTFE, moulded or otherwise formed or secured around a steel reinforcing body. To facilitate assembly and disassembly of the sub 60, various ports 82 are provided in the sleeve 68 to allow bearings to be placed in or removed from the appropriate bearing tracks 76, 77 between the mandrel 62 and the sleeve 68.

To disassemble the sub 60, the ports 82 are opened and the bearings 74 removed therethrough. The collar 70 is then disengaged from the thread 72 and removed from the mandrel 62. The sleeve 68 may then be lifted over the upper end of the mandrel 62. To reassemble the sub 60 these steps are simply repeated in the reverse order.

Figure 8:
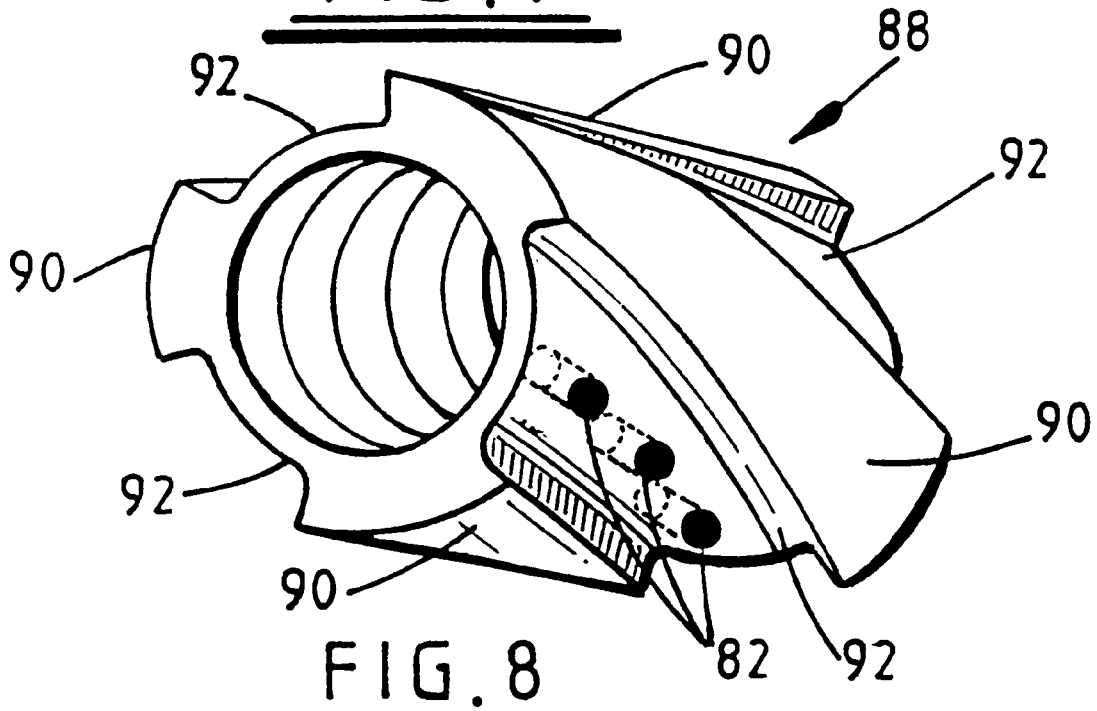
FIG. 8 is a perspective view of an alternative sleeve for the component of FIG. 5.

Reference is now also made to FIG. 8 of the drawings, which illustrates an alternative sleeve 88 defining three helically extending blades 90 with undercut channels 92 extending therebetween; the undercut channels 92 provide a larger flow area between the blades 90 while not reducing the contact area provided by the blades 90.

It will be clear to those of skill in the art that the above-described embodiments are merely exemplary of the present invention, and that various modifications and improvements may be made thereto, without departing from the scope of the present invention. In a further embodiment, the sub 30 described above may be modified by the provision of a sleeve defining a series of blades, and in a still further embodiment the sleeve may include means to permit for filling of the gap between the sleeve 38 and the mandrel 32 with bearings, which may be in the form of a large number of glass balls.

What is claimed is:

1. A friction-reducing drill pipe component for forming part of a drill string, the component comprising a tubular mandrel having first and second ends for connection to adjacent components of a drill string, a sleeve mounted on the mandrel, and first and second stops on the mandrel, intermediate the first and second ends, for restraining the sleeve against axial movement relative to the mandrel, at least the first stop being movable to a retracted position while retained on the mandrel, wherein an outermost diameter described by the first stop in the retracted position and the mandrel in combination is less than an inner diameter of the sleeve to permit the sleeve to be removed over the first end of the mandrel.

2. The component of claim 1, wherein the sleeve is rotatable relative to the mandrel.

3. The component of claim 2, wherein the sleeve and mandrel define bearing surfaces.

4. The component of claim 2, wherein bearings are provided between the sleeve and mandrel.

5. The component of claim 4, wherein the bearings are introduced into a gap between the sleeve and the mandrel through a port in the sleeve.

6. The component of claim 2, wherein at least one opening is provided in one of the sleeve and mandrel to permit drilling fluid in the bore to enter a gap between the sleeve and mandrel and serve as a lubricant therebetween.

7. The component of claim 6, wherein the spacing of the stops and the length of the sleeve are selected to provide a flow path between the stops and the sleeve ends.

8. The component of claim 7, wherein one of said first stop and said first end of the sleeve is configured to permit flow of fluid therebetween in the event that the contact between the sleeve and bore wall and downward movement of the drill string relative to the bore wall causes the sleeve to be pushed upwardly into contact with the first stop.

9. The component of claim 8, wherein the first stop is scalloped.

10. The component of claim 1 wherein the first stop is in the form of a collar.

11. The component of claim 10, wherein the collar is retained on the mandrel by therefore retracted connectors.

12. The component of claim 11, wherein the connectors are sprung dogs which normally extend radially from the mandrel to engage and retain the collar.

13. The component of claim 11, wherein the collar further defines ports formed therethrough to permit access to the connectors.

14. The component of claim 13, wherein the collar further defines slots in communication with the ports so that the collar may be rotated to cover the connectors.

15. The component of claim 1, wherein the second stop is in the form of a stop ring.

16. The component of claim 15, wherein the stop ring is integral with the mandrel.

17. The component of claim 16, wherein the mandrel, the mandrel ends and the second stop are machined from a single piece of metal.

18. The component of claim 1 wherein the first stop and the sleeve are each formed of single pieces of metal.

19. The component of claim 1 wherein the sleeve has a cylindrical outer surface.

20. The connector of claim 1, wherein the sleeve carries external blades with slots therebetween.

21. The connector of claim 20, wherein at least the blade surfaces are of resilient material.

22. The connector of claim 20, wherein the slots are undercut.

23. A friction-reducing drill pipe component for forming part of a drill string, the component comprising a tubular mandrel having first and second ends for connection to adjacent components of a drill string, a sleeve mounted on the mandrel, and spring-mounted lock dogs mounted on the mandrel and operatively associated with the sleeve for releasably retaining the sleeve on the mandrel, the released sleeve being removable over the first end of the mandrel.

24. A friction-reducing drill pipe component for forming part of a drill string, the component comprising a unitary tubular mandrel having first and second ends for connection to adjacent components of a drill string, a sleeve directly mounted on the mandrel, first and second stops on the mandrel for restraining the sleeve against axial movement relative to the mandrel, at least the first stop being moveable to a retracted position while being retained on the mandrel, wherein an outermost diameter described by the first stop in the retracted position and the mandrel in combination is less than an inner diameter of the sleeve to permit the sleeve to be removed from the mandrel, the sleeve being rotatable relative to the mandrel, and the sleeve and the mandrel each defining plane bearing surfaces.

25. A friction-reducing drill pipe component for forming part of a drill string, the component comprising a tubular mandrel having first and second ends for connection to adjacent components of a drill string, a sleeve mounted on the mandrel, and first and second stops on the mandrel, intermediate the first and second ends, for restraining the sleeve against axial movement relative to the mandrel, at least the first stop being movable to a retractable position wherein an outermost diameter described by the first stop in the non-operative position and the mandrel in combination is less than an inner diameter of the sleeve to permit the sleeve to be removed over the first end of the mandrel, and wherein the sleeve is rotatable relative to the mandrel and bearings are introduced into a gap between the sleeve and the mandrel through a port in the sleeve.

26. A friction-reducing drill pipe component for forming part of a drill string, the component comprising a tubular mandrel having first and second ends for connection to adjacent components of a drill string, a sleeve mounted on the mandrel, and first and second stops on the mandrel, intermediate the first and second ends, for restraining the sleeve against axial movement relative to the mandrel, at least the first stop being movable to a retractable position wherein an outermost diameter described by the first stop in the non-operative position and the mandrel in combination is less than an inner diameter of the sleeve to permit the sleeve to be removed over the first end of the mandrel, and at least one opening is provided in one of the sleeve and mandrel to permit drilling fluid in the bore to enter a gap between the sleeve and mandrel and serve as a lubricant therebetween.

27. The component of claim 26, wherein the spacing of the stops and the length of the sleeve are selected to provide a flow path between the stops and the sleeve ends.

28. The component of claim 27, wherein one of said first stop and said first end of the sleeve is configured to permit flow of fluid therebetween in the event that the contact between the sleeve and bore wall and downward movement of the drill string relative to the bore wall causes the sleeve to be pushed upwardly into contact with the first stop.

29. The component of claim 28, wherein the first stop is scalloped.

30. A friction-reducing drill pipe component for forming part of a drill string, the component comprising a tubular mandrel having first and second ends for connection to adjacent components of a drill string, a sleeve mounted on the mandrel, and first and second stops on the mandrel, intermediate the first and second ends, for restraining the sleeve against axial movement relative to the mandrel, at least the first stop being movable to a retracted position wherein an outermost diameter described by the first stop in the retracted position and the mandrel in combination is less than an inner diameter of the sleeve to permit the sleeve to be removed over the first end of the mandrel, wherein the first stop is in the form of a collar retained on the mandrel by retractable connectors.

31. The component of claim 30, wherein the connectors are sprung dogs which normally extend radially from the mandrel to engage and retain the collar.

32. The component of claim 30, wherein the collar further defines ports formed therethrough to permit access to the connectors.

33. The component of claim 32, wherein the collar further defines slots in communication with the ports so that the collar may be rotated to cover the connectors.

* * * * *